United States Patent [19]

Chupak et al.

[11] 4,209,221

[45] Jun. 24, 1980

[54] TWO-PIECE SOCKET TERMINAL

[75] Inventors: John M. Chupak, West Middlesex, Pa.; Joseph H. Gladd, Cortland; James W. McNamee, Warren, both of Ohio

[73] Assignee: General Motors Corporation, Detroit, Mich.

[21] Appl. No.: 946,218

[22] Filed: Sep. 27, 1978

[51] Int. Cl.[2] ..... H01R 15/12; H01T 13/04

[52] U.S. Cl. ..... 339/223 S; 339/276 T

[58] Field of Search ..... 339/975, 223 S, 259 R, 339/276 T

[56] References Cited

U.S. PATENT DOCUMENTS

| | | | |
|---|---|---|---|
| 1,970,767 | 8/1934 | Rabezzana | 339/975 |
| 2,024,814 | 12/1935 | Bell | 339/223 S |
| 3,223,963 | 12/1965 | Rarey et al. | 339/259 R |
| 3,320,574 | 5/1967 | Tuchel | 339/217 R |
| 3,364,459 | 1/1968 | Schiller | 339/245 |
| 3,597,723 | 8/1971 | Schmidt et al. | 339/26 |
| 3,813,645 | 5/1974 | Elliott et al. | 339/259 R |
| 4,009,924 | 3/1977 | Bungo et al. | 339/223 S |

*Primary Examiner*—Roy Lake
*Assistant Examiner*—E. F. Desmond
*Attorney, Agent, or Firm*—F. J. Fodale

[57] ABSTRACT

A two-piece socket terminal is crimped to the end of an ignition wire and detachably connected to a spark plug stud terminal. The terminal comprises an attachment member of crimpable semi-hard steel having a corrugated channel at one end and a tee-shaped support at an opposite end, and a socket member of spring tempered steel having a split sleeve at one end and a longitudinal tongue at an opposite end. The attachment and socket members are secured to each other by clamping arms of the tee-shaped support bent over the longitudinal tongue. The tongue has circumferential tabs behind the clamping arms providing a mechanical interlock in the pull-off direction while the foremost internal rib of the corrugated channel provides a stop in the push-on direction. The terminal provides a direct electrical connection between the ignition wire conductor core and the socket piece which is enhanced by forward projecting tabs of the corrugated channel. In-line and angled embodiments are disclosed.

6 Claims, 7 Drawing Figures

TWO-PIECE SOCKET TERMINAL

Figure 1:
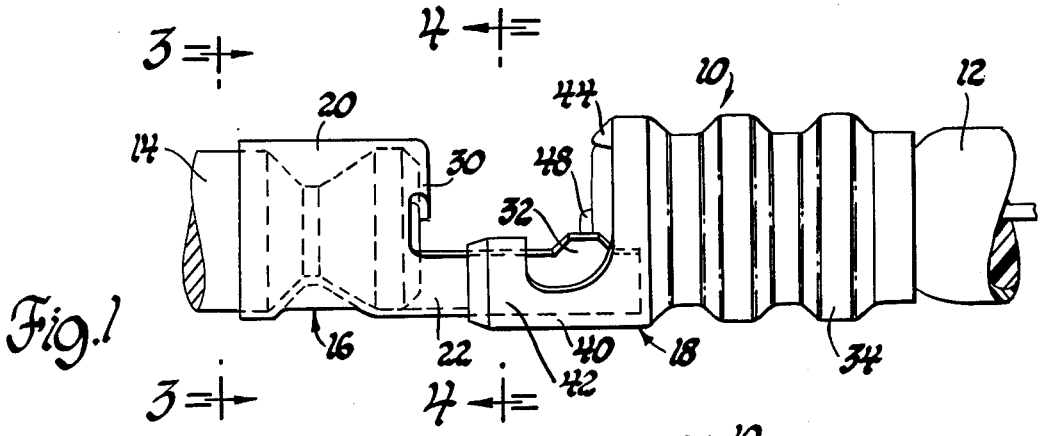

This invention relates generally to electric terminals and more particularly to electric socket terminals, such as spark plug terminals, which detachably connect lead wires to a stud terminal.

Spark plug terminals commonly comprise a terminal member of semi-hard material having an open U-shaped channel at one end which is crimped around the end of an ignition wire and a socket at the other end which fits on the stud terminal of the spark plug. The socket typically carries a spring clip which detachably retains the spark plug terminal on the stud terminal preferably in a manner which permits a detachment at substantial angles without excessive force and/or injury to the socket or the spring clip. U.S. Pat. No. 3,223,963 (Rarey et al.); U.S. Pat. No. 3,364,459 (Schiller); U.S. Pat. No. 3,597,723 (Schmidt); and U.S. Pat. No. 3,813,645 (Elliot et al) disclose spark plug terminals having a socket carrying a spring clip. U.S. Pat. No. 4,009,924 (Bungo et al.) discloses a spark plug terminal having a socket carrying a spring clip which is specially designed for detachment at high angles.

Temperatures in engine compartments of automotive vehicles are increasing as lower emission standards are required. When the above prior art constructions are used in a high temperature environment, the spring clip tends to weld itself to the terminal socket and inhibit the independent spring action of the spring clip. The spark plug terminal is then difficult to detach and, in some instances, detachment may result in permanent damage requiring replacement of the terminal.

It is also known from the U.S. Pat. No. 2,024,814 (Bell) granted Dec. 17, 1935 to provide a two-piece spark plug terminal wherein an ignition wire attachment member and a socket member are made as separate pieces which are secured together to form the terminal. The Bell patent, however, is primarily concerned with providing a socket member which can be attached either with its axis aligned or its axis transverse to the axis of the stud terminal. Consequently, the Bell patent and construction does not address itself to other considerations, such as high temperature operation, efficient electrical connection, angular pull-off, economic manufacture, etc.

The object of this invention is to provide an improved two-piece socket terminal of the type generally disclosed in the Bell patent.

Another object of this invention is to provide a two-piece socket terminal in which the socket member and the ignition wire attachment member are each of one-piece construction and made of different materials specific to the needs of each piece.

Another object of this invention is to provide a two-piece socket terminal having discrete socket and ignition wire attachment members which permit the terminal to be supplied in strip form for efficient attachment to ignition wires.

Another object of this invention is to provide a two-piece socket terminal which makes a direct electrical connection between the conductor core of the ignition wire and the socket member of the terminal for an efficient electrical connection.

Another object of this invention is to provide a two-piece socket terminal in which the entire socket member is of one-piece construction and made of spring tempered steel for an improved electrical connection under conditions of vibration.

Yet another object of this invention is to provide a two-piece socket terminal in which one piece is a spring tempered socket member secured to a one-piece semi-hard ignition wire attachment member in a simple and efficient manner which does not substantially effect the independent action of the spring tempered socket member should it self-weld to the attachment member during operation in a high temperature environment.

Yet another object of this invention is to provide a two-piece socket terminal having a crimpable ignition wire attachment member in which the crimpability of the attachment member is advantageously utilized in securing the spring tempered socket member and effecting an efficient direct electrical connection between the socket member and the ignition wire conductor core.

Figure 2:
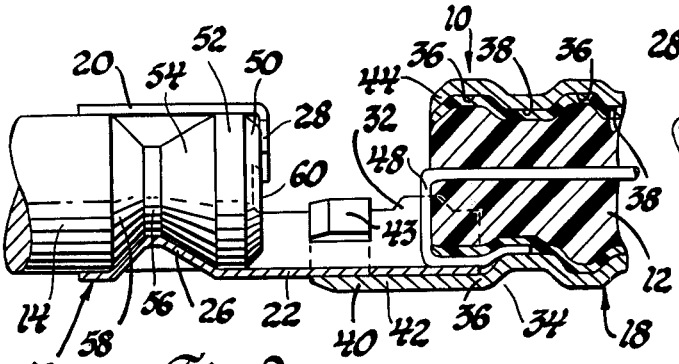
Figure 3:
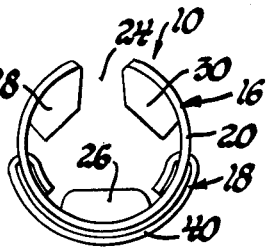
Figure 4:
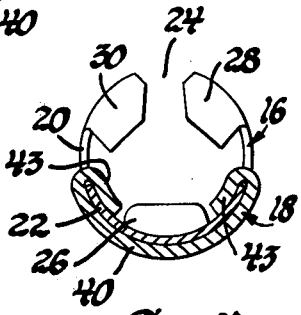
Figure 5:
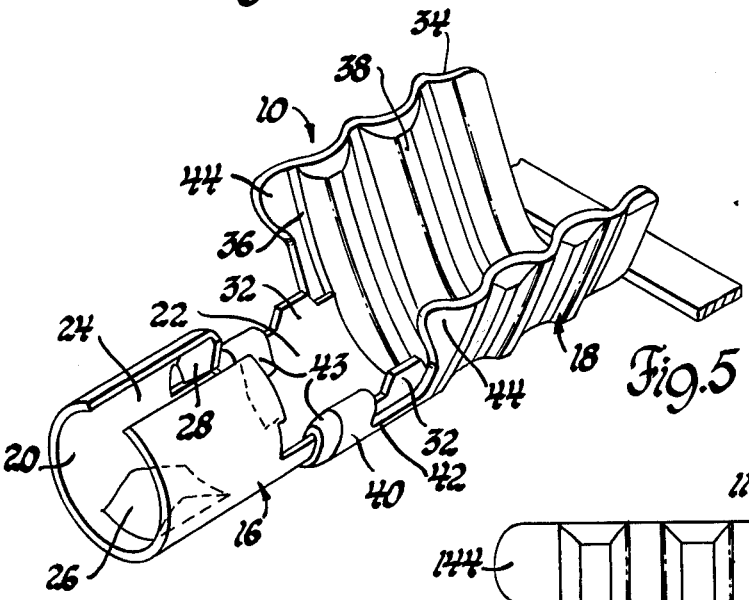
Figure 7:
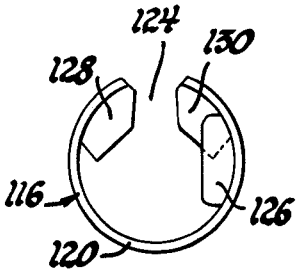
Figure 6:
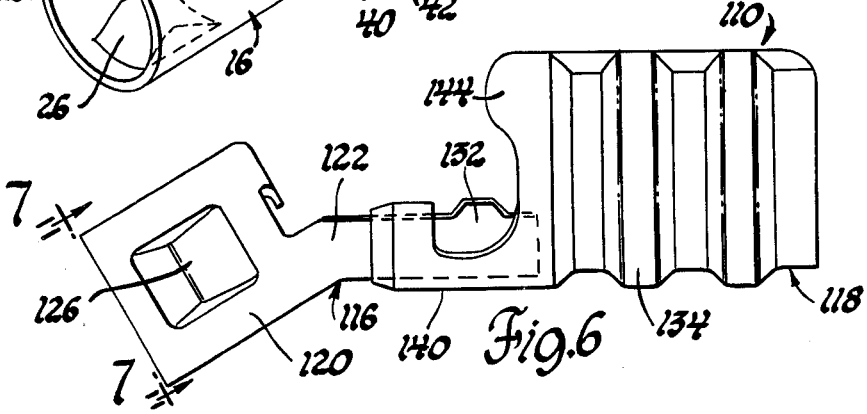

Other objects and features of the invention will become apparent to those skilled in the art as the disclosure is made in the following detailed description of a preferred embodiment of the invention as illustrated in the accompanying sheet of drawing in which:

FIG. 1 is a side view showing a two-piece spark plug terminal in accordance with this invention permanently attached to an ignition wire at one end and detachably connected to a stud terminal of a spark plug at the other end, FIG. 2 is a portion of FIG. 1 showing the spark plug terminal in section, FIG. 3 is a front view of the spark plug terminal taken substantially along the line 3—3 of FIG. 1 looking in the direction of the arrows, FIG. 4 is a section of the spark plug terminal taken substantially along the line 4—4 of FIG. 1 looking in the direction of the arrows, FIG. 5 is a perspective view of the two-piece spark plug terminal shown in FIG. 1 attached to a carrier strip prior to its attachment to the ignition wire, FIG. 6 is a side view of a modified two-piece spark plug terminal in accordance with this invention, and FIG. 7 is a front view of the modified spark plug terminal taken substantially along the line 7—7 of FIG. 6 looking in the direction of the arrows.

Referring now to the drawing, FIG. 1 illustrates a spark plug terminal 10 permanently attached to an ignition wire 12 at one end and detachably connected to a spark plug stud terminal 14 at the other end. As best illustrated in FIG. 5, the terminal 10 is a two-piece assembly comprising a one-piece socket member 16 and a one-piece ignition wire attachment member 18.

The socket member 16 comprises a circular split sleeve 20 having an elongated tongue 22. The socket member 16 is rolled from a flat blank so that the circular split sleeve 20 extends about 330° and defines a longitudinal gap 24 of about 30°. The sleeve 20 has an inwardly projecting detent 26 diametrically opposite the gap 24 and a pair of radial stop flanges 28 and 30 on opposite sides of the gap 24 at a rearward edge. The elongated tongue 22 also diametrically opposite the gap 24 is arcuate in section and is an integral extension contiguous the rearward edge of the sleeve 20. The elongated tongue 22 has a pair of circumferential tabs 32 longitudinally spaced from the sleeve 20 and adjacent an end remote from the sleeve 20.

The attachment member 18 comprises an open U-shaped channel 34 which is corrugated in longitudinal section providing a series of inner circumferential troughs 36 and ribs 38. The attachment member 18 further comprises a teeshaped support 40 extending from a forward end of the channel 34. The support 40 is arcuate in cross section and matches the curvature of the elongated tongue 22 as best shown in FIG. 4. The neck 42 of the support 40 is an integral extension of the channel 34 and coplanar with a trough 36 at the forward end to provide a continuous surface for the tongue 22 as best shown in FIG. 2. The channel 34 has a pair of forwardly projecting tabs 44 at the respective free ends of the open U-shaped channel 34 so that the tabs 44 are diametrically opposite the neck 42 when the channel 34 is crimped about the end of the ignition wire 12.

The socket member 16 is intended for snap assembly to the stud terminal 14 and establishing a good electrical contact therewith. Consequently the socket member 16, particularly the split sleeve 20, requires a material, such as a spring tempered steel, which is hard, electrically conductive, highly resilient and dimensionally stable to insure good retention and electrical contact even after repeated removal and assembly.

The attachment member 18, on the other hand, is intended for a permanent crimp attachment to an ignition wire. Consequently, the attachment piece 18 requires a material which is crimpable or permanently deformable without any significant recovery. Thus, the material requirements of the socket member 16 and the attachment member 18 are diverse and somewhat incompatible.

These diverse requirements can be met for instance by using a semi-hard zinc coated steel for the attachment member 18 which is a commonly used material for prior art spark plug terminals of the type shown in the aforementioned Rarey et al patent and a cold rolled carbon spring steel which is austempered after socket member 18 is formed. The use of different materials specific to the needs of each member also permits the spark plug terminals to be supplied in strip form (usually coiled in reels) to facilitate assembly to the ignition wires by automated machinery in a conventional manner.

The attachment member 18 being of a semi-hard crimpable material can be made by conventional progressive die forming techniques while attached to a carrier strip by a severable tab and thus the attachment members can be supplied in a conventional strip form as shown in FIG. 5. The socket member 16 being of a spring tempered material, can then be conveniently made as loose pieces and assembled to the attachment members resulting in completed terminals in strip form.

The socket member 16 and the attachment member 18 are shaped to facilitate assembly to each other and take advantage of the characteristics of the material of each member. The spring tempered socket member 16 does not require any reshaping and the mechanical securement of the two members is effected solely by reshaping the attachment member 18 of crimpable material. Specifically the elongated tongue 22 of the socket member 16 is merely laid on the tee-shaped support 40 and foremost trough 36 of the open U-shaped channel 34. The arms 43 of the tee-shaped support 40 are then bent around over the edges of the tongue 22 ahead of the circumferential tabs 32. This clamps the tongue 22 in place and provides a mechanical interlock between the two members in the pull-off direction which generally experiences greater forces. The design also takes advantage of the corrugated shape of the U-shaped channel 34 inasmuch as the foremost rib 38 acts as a stop for the socket member 16 in the push-on direction should the clamping force of the bent over arms 43 be insufficient.

The open U-shaped channel 34 permanently attaches the terminal 10 to the ignition wire 12 with a conventional strip and fold technique. More specifically, the ignition wire 12 has an end portion of its insulation stripped away to expose a length of its conductor core 48 which is then folded back against the insulator jacket. The end of the ignition wire 12 with the folded back conductor core 48 is then placed in the open U-shaped channel 34 which is then tightly crimped around the end of the ignition wire 12 trapping the conductor core 48 between the insulation jacket and the now barrel-shaped channel 34.

As particularly disclosed in FIG. 2, a portion of the folded back conductor core 48 is also trapped against the elongate tongue 22 establishing a direct current path between the conductor core 48 and the socket member 16. The forward projecting tabs 44 of the crimped barrel-shaped channel 34 extend readily inwardly against the end of the ignition wire 12 exerting a pressure which biases the conductor core 48 against the elongated tongue 22 for improved electrical contact. The tabs 44 also locate the forward end of the ignition wire 12 and inhibit fraying of the normally exposed front end of the insulation.

The terminal 10 secured to the ignition wire 12 may be repeatedly attached to and detached from the spark plug stud terminal 14 shown in FIG. 1 by means of the socket member 16. The standard spark plug stud terminal 14 is of standard configuration, comprising a diverging conical end portion 50, a cylindrical band portion 52, a converging conical portion 54, a cylindrical neck 56 and a tapered shoulder 58. When the terminal 10 is attached to the spark plug stud terminal 14, the split sleeve 20 is cammed open as the detent 26 snaps past the cylindrical band portion 52 and engages the conical portion 54 to resist detachment and the stop flanges 28 and 30 engage the flat end surface 60 to prevent over-insertion. In the assembled position the split sleeve 20 is still stressed and has a tight resilient fit against the cylindrical band portion 52 maintained by its spring-like qualities. Since the split sleeve 20 is spaced from the portions mechanically connecting the two members, the independent spring action of the split sleeve 20 is not substantially effected by any welding which might occur between the members 16 and 18 during operation in a high temperature environment.

The embodiment shown in FIGS. 1 through 5 is an in-line terminal, that is, the longitudinal axes of the split sleeve 20 and the attachment channel 34 are aligned. This invention is also applicable to an angular type terminal, for example, the spark plug terminal 110 shown in FIGS. 6 and 7. In this embodiment the axis of the split sleeve 120 is set at an angle to the axis of the channel 134 by bending the portion of the elongated tongue 122 adjacent the split sleeve 120.

The detent 126 is also relocated to an orthogonal position in relation to the gap 124. The natural tendency is to detach angular terminals by rotating the channel 134 in a direction toward the gap 124 (counterclockwise as shown in FIG. 6) resulting in detachment at a very high angle. The orthogonal location of the detent 126 reduces binding of the split sleeve 120 against the stud terminal during detachment under these conditions. The terminal 110 shown in FIGS. 6 and 7 is otherwise the same as that shown in FIGS. 1–5 and corresponding parts are identified by adding 100 to the identifying numerals.

I wish it to be understood that I do not desire to be limited to the exact details of construction shown and described, for obvious modifications will occur to a person skilled in the art.

What is claimed is:

1. A two piece socket terminal for detachably connecting an ignition wire or the like to a mating stud terminal comprising:

an attachment member of crimpable material having a channel at one end for permanently attaching the terminal to an ignition wire or the like and a support at an opposite end including a pair of transverse arms, and a socket member of spring tempered metal having a split sleeve at one end for receiving a stud terminal and a longitudinal tongue at an opposite end which is disposed on the support and secured to the attachment member by the pair of transverse arms being bent over opposite longitudinal edges of the longitudinal tongue and clampingly engaging portions of the longitudinal tongue spaced from the split sleeve, said socket member having radial flange means for preventing over-insertion of the stud terminal and said split sleeve having inwardly projecting detent means for retaining the stud terminal therein.

2. A two-piece socket terminal for detachably connecting an ignition wire or the like to a mating stud terminal comprising:

an attachment member of crimpable material having a channel at one end for permanently attaching the terminal to an ignition wire or the like and a tee-shaped support at an opposite end, and a socket member of spring tempered metal having a split sleeve at one end for receiving a stud terminal and a longitudinal tongue at an opposite end which is disposed on the tee-shaped support and secured to the attachment member by bent over arms of the tee-shaped support which clampingly engage portions of the longitudinal tongue and are spaced from the split sleeve, said split sleeve having radial flange means adjacent a longitudinal gap for preventing over-insertion of the stud terminal and an inwardly projecting detent circumferentially spaced from the gap for retaining the stud terminal therein.

3. A two-piece socket terminal for detachably connecting an ignition wire or the like to a mating stud terminal comprising:

an attachment member of crimpable metal having a corrugated channel at one end for permanently attaching the terminal to an ignition wire or the like and a support at an opposite end which is contiguous an internal circumferential trough of the corrugated channel to provide a continuous surface, a socket member of spring tempered metal having a split sleeve at one end for receiving a stud terminal and a longitudinal tongue at an opposite end which is disposed on the continuous surface defined by the support and the trough and secured to the attachment piece by bent clamping portions of the support which are spaced from the split sleeve, said longitudinal tongue having circumferential tabs disposed between the bent clamping portions of the support and the channel to provide a mechanical interlock preventing separation of the members away from each other, said socket piece having radial flange means for preventing over-insertion of the stud terminal and said split sleeve having inwardly projecting detent means for retaining the stud terminal therein.

4. A two-piece terminal for detachably connecting an ignition wire or the like to a mating stud terminal comprising:

an attachment member of crimpable metal having a corrugated channel at one end for permanently attaching the terminal to an ignition wire or the like and a support at an opposite end, said channel being corrugated in longitudinal section to provide a series of internal circumferential troughs and ribs, said support being contiguous a foremost one of said internal circumferential troughs to provide a continuous surface, a socket member of spring tempered metal having a split sleeve at one end for receiving a stud terminal and a longitudinal tongue at an opposite end, which is disposed on the continuous surface defined by the support and the foremost trough and secured to the attachment member by bent clamping portions of the support which are spaced from the split sleeve, said corrugated channel being crimpable about the end of an ignition wire and when crimped trapping a conductor core of the ignition wire folded back over its insulation against an end portion of the longitudinal tongue disposed between the insulation and the continuous surface to establish a direct electrical connection to the socket member, said socket member having radial flange means for preventing over-insertion of the stud terminal and said split sleeve having inwardly projecting detent means for retaining the stud terminal therein.

5. A two-piece socket terminal for detachably connecting an ignition wire or the like to a mating stud terminal comprising:

an attachment member of crimpable metal having a corrugated channel at one end for permanently attaching the terminal to an ignition wire or the like and a tee-shaped support at an opposite end, said channel being corrugated in longitudinal section to provide a series of internal circumferential troughs and ribs, said support being contiguous a foremost one of said internal circumferential troughs to provide a continuous surface leading to a stop provided by a foremost one of said internal circumferential ribs, a socket member of spring tempered metal having a split sleeve at one end for receiving a stud terminal and a longitudinal tongue including circumferential tabs at an opposite end, said tongue being disposed on the continuous surface with said circumferential tabs adjacent said stop, and secured to the attachment member by bent over arms of the tee-shaped support clamping portions of the tongue ahead of the circumferential tabs, said corrugated channel being crimpable about the end of an ignition wire and having forwardly projecting tabs for biasing a conductor core of the ignition wire folded back over its insulation against the elongated tongue via the ignition wire to enhance a direct electrical connection to the socket piece, said socket piece having radial flange means for preventing over-insertion of the stud terminal and said split sleeve having inwardly projecting detent means for retaining the stud terminal therein.

6. A terminal for detachably connecting an ignition wire or the like to a mating stud terminal comprising:

an attachment piece of crimpable material having a channel at one end for permanently attaching the terminal to an ignition wire or the like and a support at an opposite end including a pair of transverse arms, and a socket piece of spring tempered metal having a split sleeve at one end for receiving a stud terminal and a longitudinal tongue at an opposite end, said longitudinal tongue having circumferential tabs and being disposed on the support and secured to the attachment piece by the pair of transverse arms being bent over opposite longitudinal edges of the longitudinal tongue and clampingly engaging portions of the longitudinal tongue spaced from the split sleeve, and ahead of the circumferential tabs to provide a mechanical interlock in the pull-off direction, said socket piece having radial flange means for preventing over-insertion of the stud terminal and said split sleeve having inwardly projecting detent means for retaining the stud terminal therein.

* * * * *